US008779272B2

(12) United States Patent
Iwase

(10) Patent No.: US 8,779,272 B2
(45) Date of Patent: Jul. 15, 2014

(54) MUSICAL SOUND PRODUCING APPARATUS, RECORDING MEDIUM AND MUSICAL SOUND PRODUCING METHOD

(75) Inventor: Hiroshi Iwase, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 109 days.

(21) Appl. No.: 13/557,493

(22) Filed: Jul. 25, 2012

(65) Prior Publication Data

US 2013/0025436 A1 Jan. 31, 2013

(30) Foreign Application Priority Data

Jul. 27, 2011 (JP) ..... 2011-164299

(51) Int. Cl.
*G10H 1/06* (2006.01)

(52) U.S. Cl.
USPC ..... 84/622; 84/659; 84/719; 84/735; 84/744

(58) Field of Classification Search
None
See application file for complete search history.

(56) References Cited

U.S. PATENT DOCUMENTS 5,463,184 A * 10/1995 Kawamura ..... 84/719
6,118,065 A * 9/2000 Haruyama ..... 84/609

FOREIGN PATENT DOCUMENTS

JP 2000-259157 A 9/2000
JP 2004-053938 A 2/2004
JP 4012777 B2 9/2007
JP 2009-042483 A 2/2009

OTHER PUBLICATIONS

Japanese Office Action dated Jul. 31, 2013 (and English translation thereof) in counterpart Japanese Application No. 2011-164299.
Chinese Office Action dated Mar. 5, 2014 (and English translation thereof) in counterpart Chinese Application No. 201210321776.4.

* cited by examiner

*Primary Examiner* — Marlon Fletcher
(74) *Attorney, Agent, or Firm* — Holtz Holtz Goodman & Chick PC

(57) ABSTRACT

In the present invention, a click sound corresponding to key depression speed is generated, and the production timings of fundamental and harmonic components respectively corresponding to each footage are changed to vary from one another in accordance with a wait time, whereby the fundamental and the harmonic components to be synthesized by additive synthesis are changed to differ from one another. Next, a click sound corresponding to key release speed is generated, and the stop timings of the fundamental and harmonic components are changed to vary from one another in accordance with a wait time, whereby the fundamental and the harmonic components to be muted are changed to differ from one another. Accordingly, by the click sound being mixed with the drawbar sound having these slight tone changes, a unique drawbar sound such as that generated by the sound producing mechanism of an actual drawbar organ is generated.

14 Claims, 7 Drawing Sheets

MUSICAL SOUND PRODUCING APPARATUS, RECORDING MEDIUM AND MUSICAL SOUND PRODUCING METHOD

CROSS-REFERENCE TO RELATED APPLICATION

This application is based upon and claims the benefit of priority from the prior Japanese Patent Application No. 2011-164299, filed Jul. 27, 2011, the entire contents of which is incorporated herein by reference.

BACKGROUND OF THE INVENTION

1. Field of the Invention

The present invention relates to a musical sound producing apparatus, a recording medium, and a musical sound producing method by which the sound producing mechanism of a drawbar-type electronic organ is simulated.

2. Description of the Related Art

In a drawbar-type electronic organ (hereinafter referred to as a drawbar organ), a musical sound of a desired tone is created by nine types of sine waves having different pitches being arbitrarily combined and synthesized based on operations of nine types of drawbars indicating different footage ("16' (' is a symbol indicating feet)", "5 and ⅓'", "8'", "4'", "2 and ⅔'", "2'", "1 and ⅗'", "1 and ⅓'", and "1'").

When "16'" of the drawbars is a fundamental, "5 and ⅓'" is a note that is one octave and a fifth above the fundamental, "8'" is a note that is one octave above the fundamental (second harmonic), "4'" is a note that is two octaves above the fundamental (fourth harmonic), "2 and ⅔'" is a note that is two octaves and a fifth above the fundamental, "2'" is a note that is three octaves above the fundamental (eighth harmonic), "1 and ⅗'" is a note that is three octaves and a third above the fundamental, "1 and ⅓'" is a note that is three octaves and a fifth above the fundamental, and "1'" is a note that is four octaves above the fundamental (sixteenth harmonic).

In recent years, an electronic musical instrument has become known that produces musical sounds similar in tone to that of a drawbar organ in accordance with a sine wave additive synthesis algorithm using a waveform data readout-type sound source. For example, Japanese Patent Application Laid-open (Kokai) Publication No. 2000-259157 discloses this type of technique.

In drawbar organs, each key of the keyboard is provided with switches that control the production and muting of sound per footage, and a unique musical sound referred to as a so-called drawbar sound is created by the behavior of the switches respectively provided for each footage which are turned ON and OFF in response to key depression and release operations. However, all that is achieved in the technique disclosed in Japanese Patent Application Laid-open (Kokai) Publication No. 2000-259157 is that a fundamental and a plurality of harmonics generated based on drawbar operations are synthesized by sine-wave synthesis, and therefore there is a problem in that a unique drawbar sound such as that generated by the sound producing mechanism of an actual drawbar organ cannot be generated.

The present invention has been conceived in light of the above-described problem, and an object of the present invention is to provide a musical sound producing apparatus, a recording medium, and a musical sound producing method by which a unique drawbar sound such as that generated by the sound producing mechanism of an actual drawbar organ can be generated.

SUMMARY OF THE INVENTION

In order to achieve the above-described object, in accordance with one aspect of the present invention, there is provided a musical sound producing apparatus comprising: sound source which produces a fundamental and a plurality of harmonics of a musical sound; a sound production timing generating section which generates sound production timings of the fundamental and the plurality of harmonics to be produced by the sound source, based on a key depression operation; a sound production instructing section which instructs the sound source to produce the fundamental and the plurality of harmonics based on the sound production timings generated by the sound production timing generating section; a key release speed acquiring section which acquires a key release speed in response to a key release operation; a muting timing changing section which changes muting timings of the fundamental and the plurality of harmonics produced by the sound source, based on the key release speed acquired by the key release speed acquiring section; and a muting instructing section which instructs the sound source to mute the fundamental and the plurality of harmonics based on the muting timings changed by the muting timing changing section.

In accordance with another aspect of the present invention, there is provided a non-transitory computer-readable storage medium having stored thereon a program that is executable by a computer used in a musical sound producing apparatus, the program being executable by the computer to perform functions comprising: sound production timing generation processing for generating sound production timings of a fundamental and a plurality of harmonics of a musical sound to be produced by a sound source, based on a key depression operation; sound production instruction processing for instructing the sound source to produce the fundamental and the plurality of harmonics based on the sound production timings generated by the sound production timing generation processing; key release speed acquisition processing for acquiring a key release speed in response to a key release operation; muting timing change processing for changing muting timings of the fundamental and the plurality of harmonics produced by the sound source, based on the key release speed acquired by the key release speed acquisition processing; and muting instruction processing for instructing the sound source to mute the fundamental and the plurality of harmonics based on the muting timings changed by the muting timing change processing.

In accordance with another aspect of the present invention, there is provided a musical sound producing method used for a musical sound producing apparatus comprising: a sound production timing generating step of generating sound production timings of a fundamental and a plurality of harmonics of a musical sound to be produced by a sound source, based on a key depression operation; a sound production instructing step of instructing the sound source to produce the fundamental and the plurality of harmonics based on the sound production timings generated in the sound production timing generating step; a key release speed acquiring step of acquiring a key release speed in response to a key release operation; a muting timing changing step of changing muting timings of the fundamental and the plurality of harmonics produced by the sound source, based on the key release speed acquired by the key release speed acquiring step; and a muting instructing step of instructing the sound source to mute the fundamental and the plurality of harmonics based on the muting timings changed in the muting timing changing step.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

An embodiment of the present invention will hereinafter be described with reference to the drawings.

A. Overview of the Invention

In a drawbar organ, each key of the keyboard is provided with switches that control the production and muting of sound per footage. These switches respectively provided for each footage are not to be simultaneously turned ON in response to key depression, but to be turned ON at different timings. That is, the production timings of fundamental and harmonic components that are synthesized by additive synthesis vary from one another, whereby slight tone changes occur at the start of sound production. These tone changes which occur during a key depression are dependent on the key depression velocity (key depression speed). That is, when the key depression speed is fast, the variations in the production timings of the fundamental and harmonic components decrease, and whereby the tone changes decrease. Conversely, when the key depression speed is slow, the variations in the production timings of the fundamental and harmonic components increase, and whereby the tone changes increase.

Such tone changes also occur during key release. That is, timings at which the switches respectively provided for each footage are turned OFF in response to key release vary from one another, whereby the stop timings of the fundamental and harmonic components that are synthesized by additive synthesis differ from one another, and slight tone changes occur at the start of muting. These tone changes differ depending on the key release velocity (key release speed). That is, when the key is quickly released, the variations in the stop timings of the harmonic components decrease, and whereby the tone changes decrease. Conversely, when the key is slowly released, the variations in the stop timings of the harmonic components increase, and whereby the tone changes increase.

In an actual drawbar organ, the switches provided in each key of the keyboard for each footage constitute multiple row contacts, and therefore an order in which these switches are turned ON during key depression differs from an order in which they are turned OFF during key release. Accordingly, tone changes occurred during the key depression differ from tone changes occurred during the key release. In addition, as a result of these switches being turned ON and OFF in response to key depression and release operations, chattering noise occurs and mixes with produced musical sounds as click sounds (key clicks). In the present invention, the sound producing mechanism of a drawbar organ based on the above-described series of observations is simulated by operations (key depression processing and key release processing described hereafter) of a central processing unit (CPU), whereby a unique drawbar sound such as that generated by the sound producing mechanism of an actual drawbar organ is generated.

B. Structure

Figure 1:
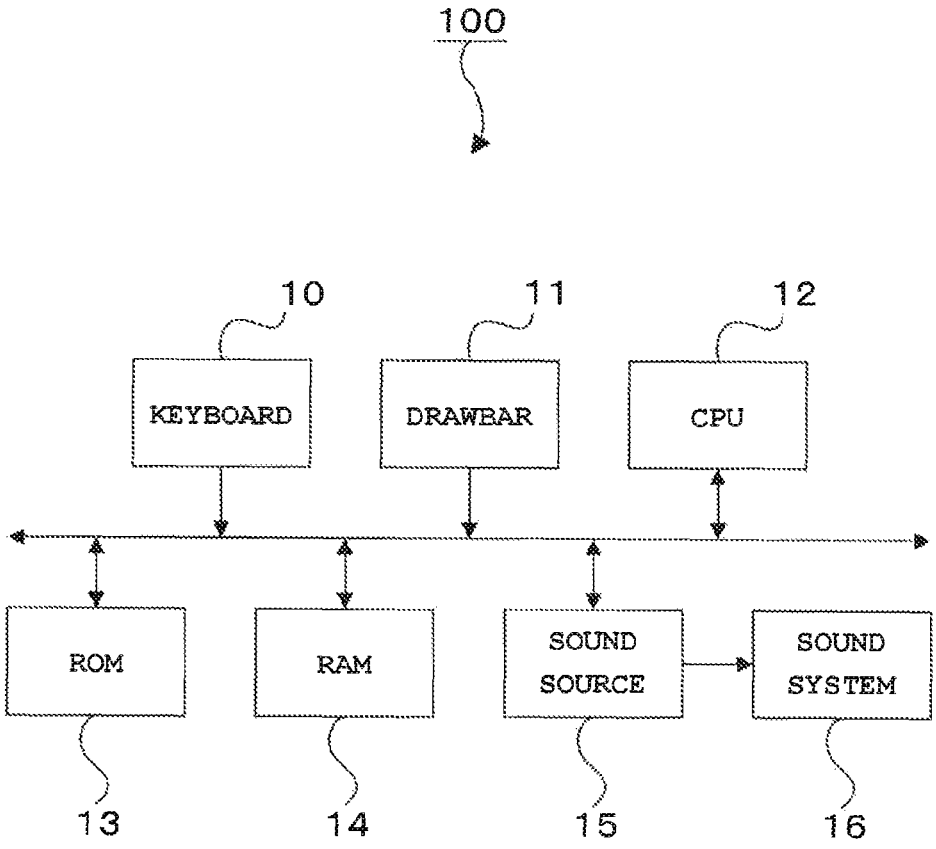
FIG. 1 is a block diagram showing the overall structure of a musical sound producing apparatus 100 according to an embodiment.
Figure 2:
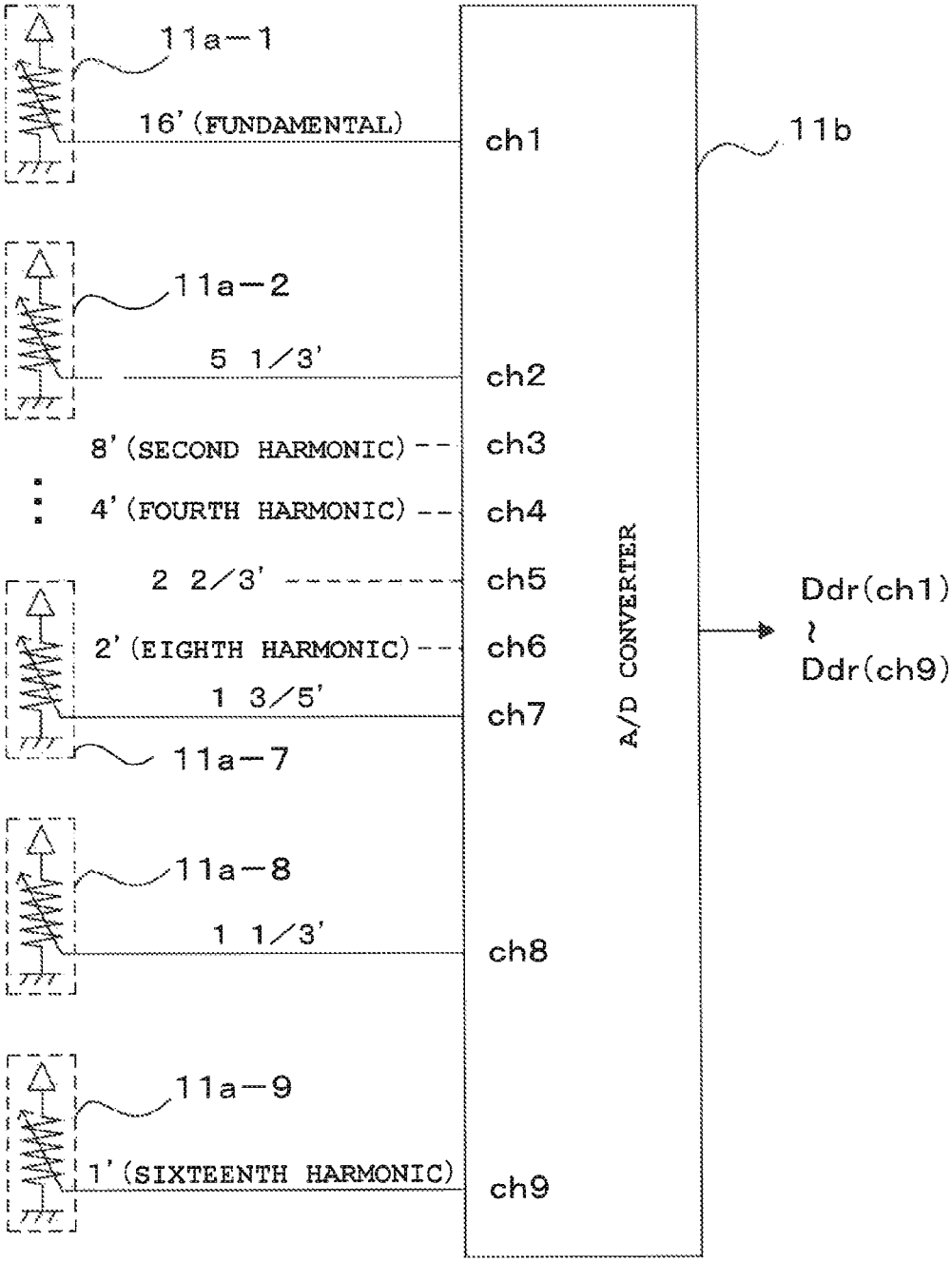
FIG. 2 is a block diagram showing the structure of a drawbar 11.
Figure 3:
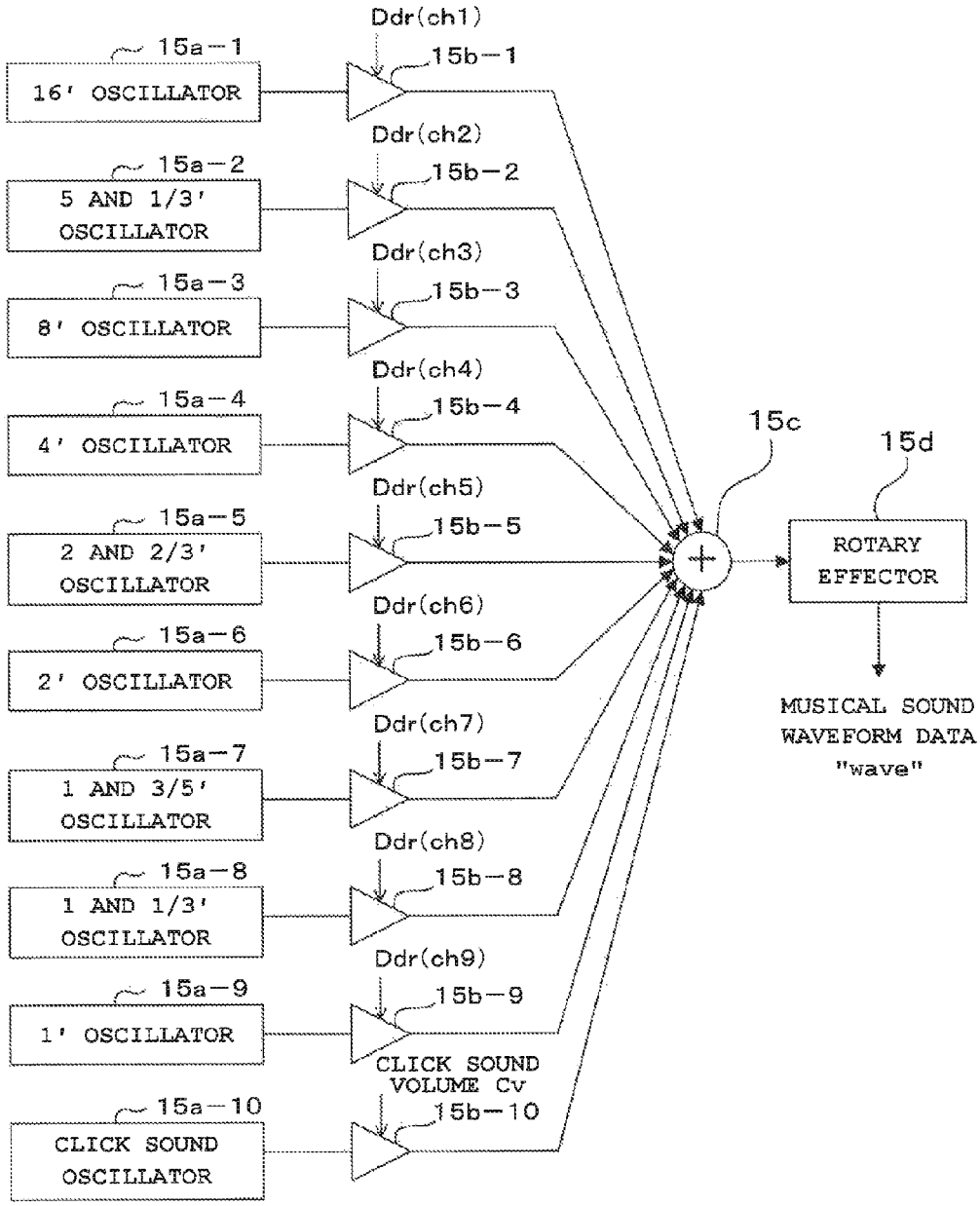
FIG. 3 is a block diagram showing the structure of a sound source 15.

Next, the structure of a musical sound producing apparatus 100 according to the embodiment of the present invention will be described with reference to FIG. 1 to FIG. 3. FIG. 1 is a block diagram showing the overall structure of the musical sound producing apparatus 100, and FIG. 2 is a block diagram showing the structure a drawbar 11. FIG. 3 is a block diagram showing the structure of a sound source 15. A keyboard 10 in FIG. 1 generates musical performance information including a key-ON/key-OFF event, a key number, and velocity (key depression velocity or key release velocity) in response to a play operation (key depression or release operation).

The drawbar 11 includes slide volume controllers 11*a*-1 to 11*a*-9 and an analog-to-digital (A/D) converter 11*b*, as shown in the example in FIG. 2. The slide volume controllers 11*a*-1 to 11*a*-9 respectively adjust the sound volumes of fundamental and harmonic components. The A/D converter 11*b* loads sound volume signals whose levels have been controlled by the slide volume controllers 11*a*-1 to 11*a*-9 into input channels ch1 to ch9, performs A/D conversion on the sound volume signals supplied to the input channels ch1 to ch9, and outputs the converted sound volume signals as drawbar outputs Ddr (ch1) to Ddr (ch9), under the control of a CPU 12. These drawbar outputs Ddr (ch1) to Ddr (ch9) are temporarily stored in a work area of a random access memory (RAM) 14, under the control of the CPU 12.

The slide volume controllers 11*a*-1 to 11*a*-9 are respectively assigned "16' (' is a symbol indicating feet)" that is a fundamental, "5 and ⅓'" that is one octave and a fifth above the fundamental, "8'" that is one octave above the fundamental (second harmonic), "4'" that is two octaves above the fundamental (fourth harmonic), "2 and ⅔'" that is two octaves and a fifth above the fundamental, "2'" that is three octaves above the fundamental (eighth harmonic), "1 and ⅗'" that is three octaves and a third above the fundamental, "1 and ⅓'" that is three octaves and a fifth above the fundamental, and "1'" that is four octaves above the fundamental (sixteenth harmonic).

The CPU 12 runs various programs stored in a read-only memory (ROM) 13, and controls the sound source 15 to create musical sounds based on musical performance information generated in response to the key depression and release operations (play operations) of the keyboard 10. The characteristic processing operations of the CPU 12 related to the scope of the present invention will be described hereafter. The ROM 13 stores various programs that are loaded into the CPU 12. The various programs herein include the main routine, key depression processing, and key release processing described hereafter. The RAM 14 includes a work area and a data area.

The work area of the RAM 14 temporarily stores various register and flag data that are used for processing by the CPU 12. Specifically, the drawbar outputs Ddr (ch1) to Ddr (ch9) generated by the drawbar 11 are temporarily stored in the work area of the RAM 14, under the control of the CPU 12. The data area of the RAM 14 stores plural types of click sound volume Cv associated with, for example, various types of velocities. Among the plural types of click sound volume Cv, click sound volume Cv corresponding to the velocity VEL of key depression (or the velocity VEL1 of key release) is read out by the CPU 12.

As shown in FIG. 3, the sound source 15 includes oscillators 15*a*-1 to 15*a*-10, coefficient multipliers 15*b*-1 to 15*b*-10, an adder 15*c*, and a rotary effector 15*d*. The sound source 15 is capable of producing polyphonic sound by operating these components by time division. The oscillators 15*a*-1 to 15*a*-9 are configured to use a known waveform data readout method in which the sine waveform data of the fundamental and the plurality of harmonics respectively corresponding to each footage of the drawbar 11 are stored and read out at a readout speed based on the key number (pitch) of a depressed key. Note that these sine waveform data of the fundamental and the plurality of harmonics respectively stored in the oscillators 15*a*-1 to 15*a*-9 have been slightly distorted to mimic the sounds of an actual drawbar organ.

The oscillator 15*a*-10 generates click waveform data equivalent to chattering noise that occurs during key depression and release operations. Specifically, the oscillator 15*a*-10 stores plural types of click waveform data associated with various types of velocities, and replays and outputs click waveform data of a waveform type selected therefrom by the CPU 12 based on the velocity of key depression (or key release). Note that a method can also be used in which click waveform data is generated by the filtering of noise waveforms and pulse waveforms, in addition to the waveform data readout method described above.

The coefficient multipliers 15*b*-1 to 15*b*-9 respectively multiply sine waveform data outputted from the oscillators 15*a*-1 to 15*a*-9 by the corresponding drawbar outputs Ddr (ch1) to Ddr (ch9), and output the sine waveform data of the fundamental and the plurality of harmonics whose levels have been controlled. These drawbar outputs Ddr (ch1) to Ddr (ch9) serving as the multiplier coefficients are read out from the work area of the RAM 14 by the CPU 12. The coefficient multiplier 15*b*-10 multiplies an output of the oscillator 15*a*-10 by the click sound volume Cv, and outputs click waveform data whose level has been controlled. The click sound volume Cv serving as the multiplier coefficient is selected and read out from the data area of the RAM 14 by the CPU 12 based on the velocity of key depression (or key release).

The adder 15*c* performs additive synthesis of the sine waveform data of the fundamental and the plurality of harmonics outputted from the coefficient multipliers 15*b*-1 to 15*b*-9, and adds thereto level-controlled click waveform data outputted from the coefficient multiplier 15*b*-10. As a result, sine wave synthesized waveform data in which click sound has been mixed is generated. The rotary effector 15*d* adds a rotary effect for mimicking the sound of an actual drawbar organ, or in other words, a unique modulation effect created by two rotating speakers (a rotor and a horn) to sine wave synthesized waveform data in which click sound has been mixed, and thereby generates musical sound waveform data "wave". A sound system 16 converts musical sound waveform data "wave" outputted from the sound source 16 to analog signal format, and after performing the elimination of unnecessary noise and level amplification, outputs the sound from a speaker.

C. Operations

Next, operations of the embodiment structured as above will be described with reference to FIG. 4 to FIG. 7. Specifically, operations in the main routine, key depression processing, and key release processing that are performed by the CPU 12 will hereinafter be described, respectively.

(1) Operations in the Main Routine

Figure 4:
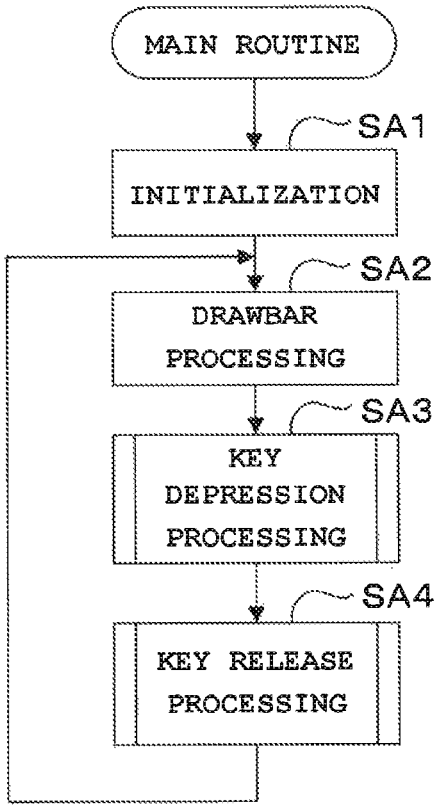
FIG. 4 is a flowchart of operations in the main routine.

When the musical sound producing apparatus 100 is turned ON, the CPU 12 proceeds to Step SA1 shown in FIG. 4. At Step SA1, the CPU 12 performs initialization to initialize each section of the musical sound producing apparatus 100, and then proceeds to Step SA2. At Step SA2, the CPU 12 performs drawbar processing to store the drawbar outputs Ddr (ch1) to Ddr (ch9) generated based on operations of the slide volume controllers 11*a*-1 to 11*a*-9 in the data area of the RAM 14.

Next, at Step SA3, the CPU 12 performs key depression processing. In this key depression processing, the production timings of fundamental and harmonic components respectively corresponding to each footage are changed to vary from one another in accordance with wait time "TIME" that changes based on key depression speed, whereby the sine waveform data of the fundamental and harmonic components to be synthesized by additive synthesis are changed to differ from one another, as described in detail later. As a result, slight tone changes that occur at the start of sound production in an actual drawbar organ are simulated in that, when the key depression speed is fast, the variations in the production timings of the fundamental and harmonic components decrease and the tone changes decrease, and when the key depression speed is slow, the variations in the production timings of the fundamental and harmonic components increase and the tone changes increase. In addition, a click sound whose waveform type and sound volume correspond to the key depression velocity VEL is generated, and mixed with the drawbar sound in which the slight tone changes occur when the sound is produced.

Next, at Step SA4, the CPU 12 performs key release processing. In this key release processing, the stop timings of the fundamental and harmonic components respectively corresponding to each footage are changed to vary from one another in accordance with wait time "TIME1" that changes based on key release speed, whereby the sine waveform data of the fundamental and harmonic components to be muted are changed to differ from one another, as described in detail later. As a result, slight tone changes that occur at the start of muting in an actual drawbar organ are simulated in that, when the key release speed is fast, the variations in the stop timings of the fundamental and harmonic components decrease and the tone changes decrease, and when the key release speed is slow, the variations in the stop timings of the fundamental and harmonic components increase and the tone changes increase. In addition, a click sound whose waveform type and sound volume correspond to the key release velocity VEL1 is generated, and mixed with the drawbar sound in which the slight tone changes occur when the sound is muted.

Then, when the key release processing at Step SA4 is completed, the CPU 12 returns to Step SA2, and hereafter repeats Step SA2 to Step SA4 described above until the power is turned OFF, whereby unique drawbar sounds such as those generated by the sound producing mechanism of an actual drawbar organ are generated.

(2) Operations in the Key Depression Processing

Figure 5:
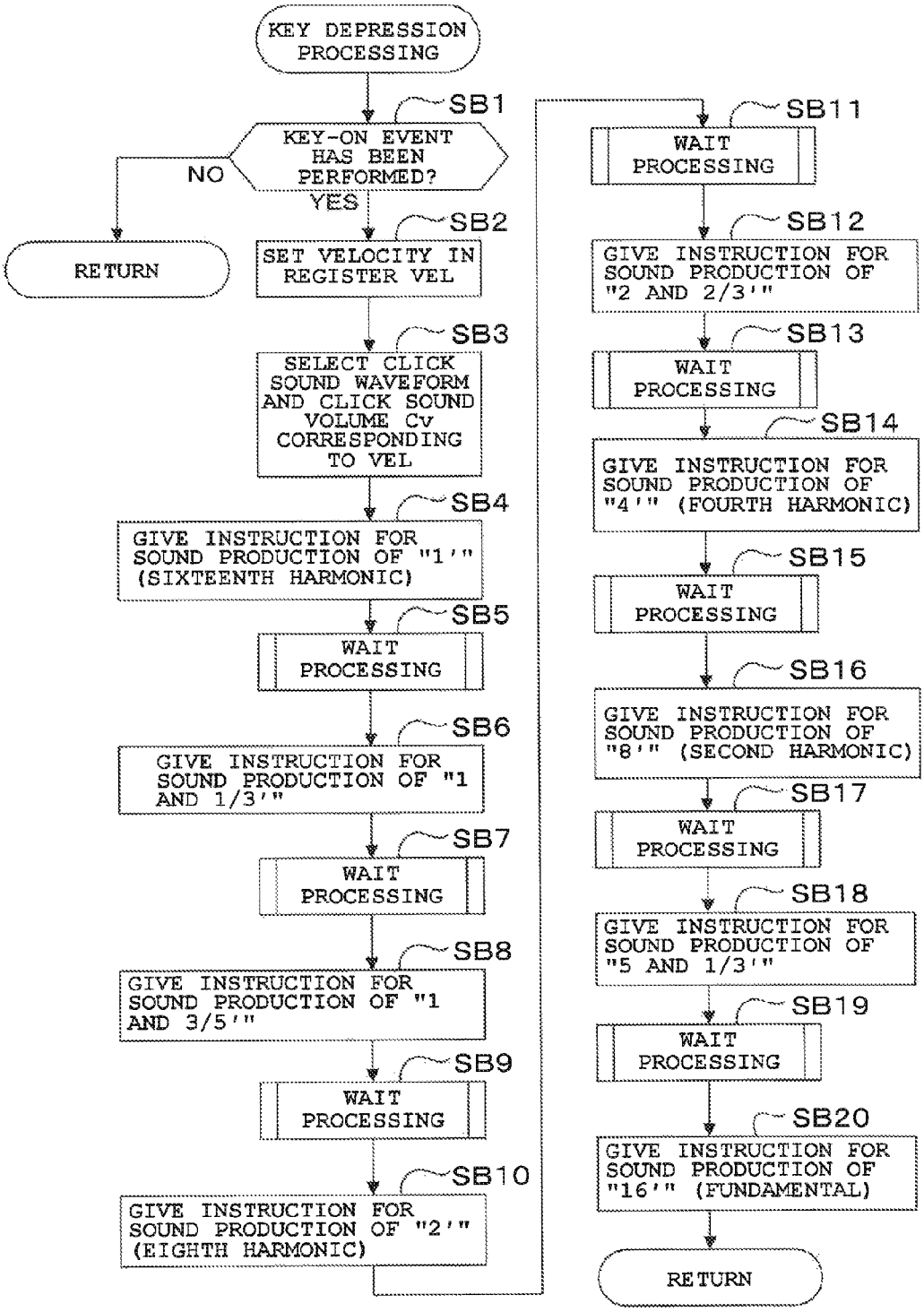
FIG. 5 is a flowchart of operations in key depression processing.

Next, the operations in the key depression processing will be described with reference to FIG. 5 to FIG. 6. When the key depression processing is performed via Step SA3 of the above-described main routine (see FIG. 4), the CPU 12 proceeds to Step SB1 shown in FIG. 5. Then, the CPU 12 judges whether or not a key-ON event has been performed, or in other words, judges whether or not any key of the keyboard 10 has been depressed. When judged that no key has been depressed, the judgment result is "NO", and therefore the CPU 12 ends the key depression processing. When judged that a key has been depressed, the judgment result is "YES", and therefore the CPU 12 proceeds to Step SB2. At Step SB2, the CPU 12 stores, in a register VEL, velocity in musical performance information outputted from the keyboard 10 in response to the key depression operation. The content of the register VEL is hereinafter referred to as key depression velocity VEL.

Next, at Step SB3, the CPU 12 instructs the oscillator 15*a*-10 of the sound source 15 to replay click waveform data whose type corresponds to the key depression velocity VEL. In addition, the CPU 12 reads out click sound volume Cv corresponding to the key depression velocity VEL from the data area of the RAM 14, and supplies it to the coefficient multiplier 15*b*-10 as a multiplier coefficient. As a result, a click sound whose type and sound volume correspond to the key depression velocity VEL is generated.

Then, the CPU 12 proceeds to Step SB4 and instructs the sound source 15 to produce the sound of the sine waveform data of a harmonic component corresponding to "1'" (sixteenth harmonic). As a result, the sine waveform data of the harmonic component (sixteenth harmonic) corresponding to "1'", which is sine waveform data read out from the oscillator 15*a*-9 at a readout speed based on the key number (pitch) of the depressed key and multiplied by the drawbar output Ddr (ch9), is generated.

Figure 6:
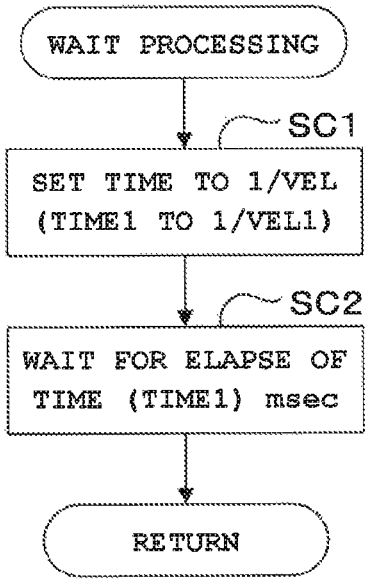
FIG. 6 is a flowchart of operations in WAIT processing.

Next, the CPU 12 performs WAIT processing shown in FIG. 6, via Step SB5. When the WAIT processing is performed, the CPU 12 proceeds to Step SC1 and calculates the inverse of the key depression velocity VEL as the wait time "TIME" (unit: msec). At subsequent Step SC2, the CPU 12 waits until the calculated wait time "TIME" has elapsed. Accordingly, the wait time "TIME" is short when the key depression is fast, and long when the key depression is slow.

Then, when the wait time "TIME" has elapsed, the CPU 12 proceeds to Step SB6 and instructs the sound source 15 to produce the sound of the sine waveform data of a harmonic component corresponding to "1 and ⅓'". As a result, the sine waveform data of the harmonic component corresponding to "1 and ⅓'", which is sine waveform data read out from the oscillator 15*a*-8 at a readout speed based on the key number (pitch) of the depressed key and multiplied by the drawbar output Ddr (ch8), is generated. Subsequently, the CPU 12 performs the WAIT processing at Step SB7, and waits until the wait time "TIME" calculated from the inverse of the key depression velocity VEL has elapsed.

At subsequent Step SB8 to Step SB9, similarly, the CPU 12 generates the sine waveform data of a harmonic component corresponding to "1 and ⅗'" whose level has been controlled based on the drawbar output Ddr (ch7), and waits until the wait time "TIME" calculated from the inverse of the key depression velocity VEL has elapsed. Next, at Step SB10 to Step SB11, the CPU 12 generates the sine waveform data of a harmonic component corresponding to "2'" (eighth harmonic) whose level has been controlled based on the drawbar output Ddr (ch6), and waits until the wait time "TIME" calculated from the inverse of the key depression velocity VEL has elapsed.

Next, at Step SB12 to Step SB13, the CPU 12 generates the sine waveform data of a harmonic component corresponding to "2 and ⅔'" whose level has been controlled based on the drawbar output Ddr (ch5), and waits until the wait time "TIME" calculated from the inverse of the key depression velocity VEL has elapsed. Next, at Step SB14 to Step SB15, the CPU 12 generates the sine waveform data of a harmonic component corresponding to "4'" (fourth harmonic) whose level has been controlled based on the drawbar output Ddr (ch4), and waits until the wait time "TIME" calculated from the inverse of the key depression velocity VEL has elapsed.

Next, at Step SB16 to Step SB17, the CPU 12 generates the sine waveform data of a harmonic component corresponding to "8'" (second harmonic) whose level has been controlled based on the drawbar output Ddr (ch3), and waits until the wait time "TIME" calculated from the inverse of the key depression velocity VEL has elapsed. Next, at Step SB18 to Step SB19, the CPU 12 generates the sine waveform data of a harmonic component corresponding to "5 and ⅓'" whose level has been controlled based on the drawbar output Ddr (ch2), and waits until the wait time "TIME" calculated from the key depression velocity VEL has elapsed. Then, at Step SB20, the CPU 12 generates the sine waveform data of a fundamental corresponding to "16'" whose level has been controlled based on the drawbar output Ddr (ch1), and ends the key depression processing.

As described above, in the key depression processing, the production timings of fundamental and harmonic components respectively corresponding to each footage are changed to vary from one another in accordance with the wait time "TIME" that changes based on key depression speed, whereby the sine waveform data of the fundamental and harmonic components to be synthesized by additive synthesis are changed to differ from one another. As a result, slight tone changes that occur at the start of sound production in an actual drawbar organ are simulated in that, when the key depression speed is fast, the variations in the production timings of the fundamental and harmonic components decrease and the tone changes decrease, and when the key depression speed is slow, the variations in the production timings of the fundamental and harmonic components increase and the tone changes increase. In addition, a click sound whose waveform type and sound volume correspond to the key depression velocity VEL is generated and mixed with the drawbar sound in which the slight tone changes occur at the start of sound production. Therefore, performance expression more similar to that of an actual drawbar organ is realized.

(3) Operations in the Key Release Processing

Figure 7:
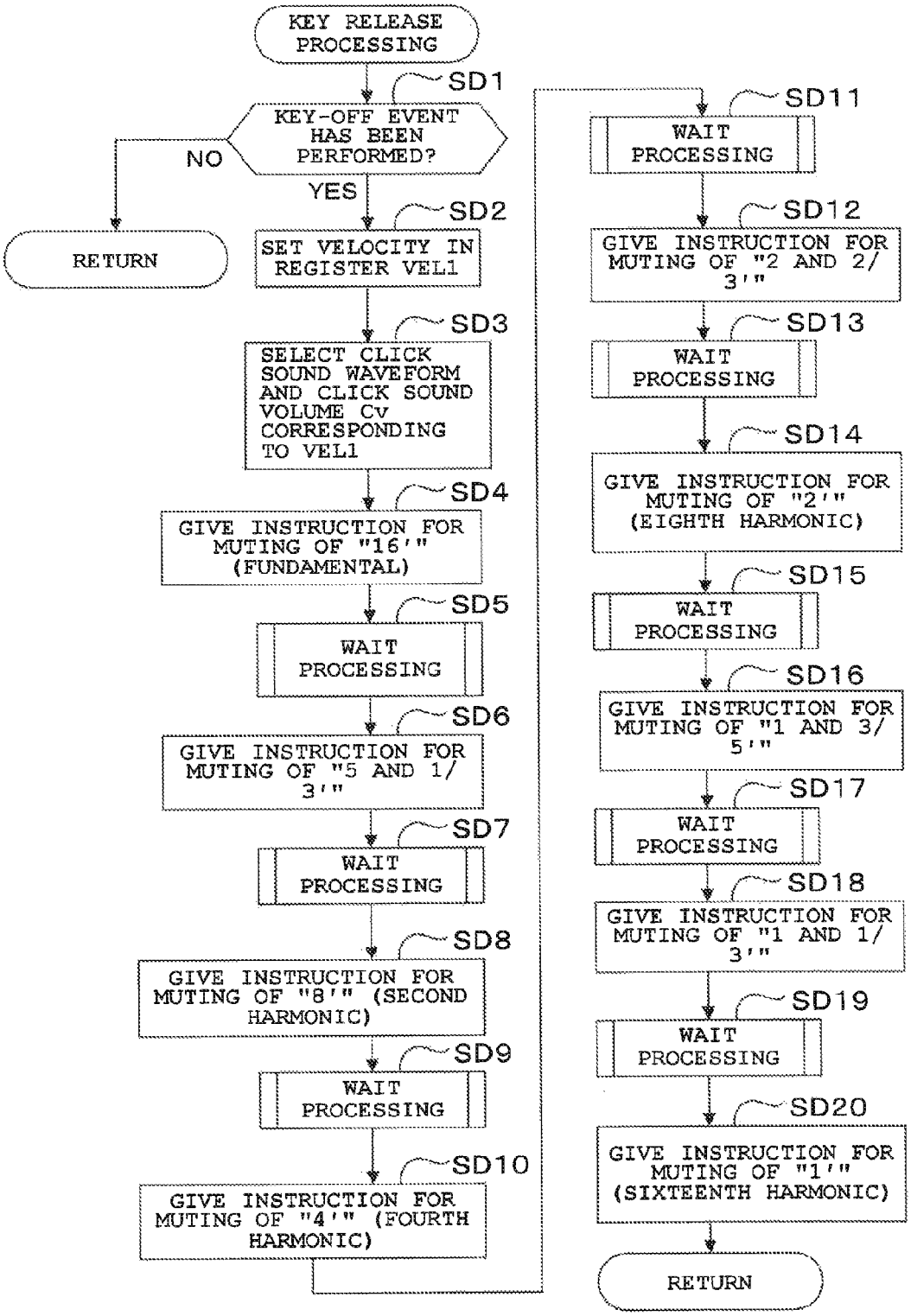
FIG. 7 is a flowchart of operations in key release processing.

Next, the operations in the key release processing will be described with reference to FIG. 7. When the key release processing is performed via Step SA4 of the above-described main routine (see FIG. 4), the CPU 12 proceeds to Step SD1 shown in FIG. 7. Then, the CPU 12 judges whether or not a key-OFF event has been performed, or in other words, judges whether or not any key of the keyboard 10 has been released. When judged that no key has been released, the judgment result is "NO", and therefore the CPU 12 ends the key release processing. When judged that a key has been released, the judgment result is "YES", and therefore the CPU 12 proceeds to Step SD2. At Step SD2, the CPU 12 stores, in a register VEL1, velocity in musical performance information outputted from the keyboard 10 in response to the key release operation. The content of the register VEL1 is hereinafter referred to as key release velocity VEL1.

Next, at Step SD3, the CPU 12 instructs the oscillator 15*a*-10 of the sound source 15 to replay click waveform data whose type corresponds to the key release velocity VEL1. In addition, the CPU 12 reads out click sound volume Cv corresponds to the key release velocity VEL1 from the data area of the RAM 14, and supplies it to the coefficient multiplier 15*b*-10 as a multiplier coefficient. As a result, a click sound whose type and sound volume correspond to the key release velocity VEL1 is generated.

Then, the CPU 12 proceeds to Step SD4 and instructs the sound source 15 to mute the sound of the sine waveform data of the fundamental corresponding to "16'" and stops waveform output from the oscillator 15*a*-1. Next, the CPU 12 performs the WAIT processing shown in FIG. 6, via Step SD5. When the WAIT processing is performed, the CPU 12 proceeds to Step SC1 and calculates the inverse of the key release velocity VEL1 as the wait time "TIME1" (unit: msec). At subsequent Step SC2, the CPU 12 waits until the calculated wait time "TIME1" has elapsed. Accordingly, the wait time "TIME1" is short when the key release is fast and long when the key release is slow.

Then, when the wait time "TIME1" has elapsed, the CPU 12 proceeds to Step SC6, instructs the sound source 15 to mute the sound of the side waveform data of the harmonic component corresponding to "5 and ⅓'", and stops waveform output from the oscillator 15*a*-2. At subsequent Step SD7, the CPU 12 performs the WAIT processing and waits until the wait time "TIME1" calculated from the inverse of the key release velocity VEL1 has elapsed.

At subsequent Step SD8 to Step SD9, similarly, the CPU 12 stops the waveform output of the sine waveform data of the second harmonic corresponding to "8'" and waits until the wait time "TIME1" calculated from the inverse of the key release velocity VEL1 has elapsed. Next, at Step SD10 to Step SD11, the CPU 12 stops the waveform output of the sine waveform data of the fourth harmonic corresponding to "4'" and waits until the wait time "TIME1" calculated from the inverse of the key release velocity VEL1 has elapsed. Next, at Step SD12 to Step SD13, the CPU 12 stops the waveform output of the sine waveform data of the harmonic component corresponding to "2 and ⅔'" and waits until the wait time "TIME1" calculated from the inverse of the key release velocity VEL1 has elapsed.

Next, at Step SD14 to Step SD15, the CPU 12 stops the waveform output of the sine waveform data of the eighth harmonic corresponding to "2'" and waits until the wait time "TIME1" calculated from the inverse of the key release velocity VEL1 has elapsed. Next, at Step SD16 to Step SD17, the CPU 12 stops the waveform output of the sine waveform data of the harmonic component corresponding to "1 and ⅗'" and waits until the wait time "TIME1" calculated from the inverse of the key release velocity VEL1 has elapsed. Next, at Step SD18 to Step SD19, the CPU 12 stops the waveform output of the sine waveform data of the harmonic component corresponding to "1 and ⅓'" and waits until the wait time "TIME1" calculated from the inverse of the key release velocity VEL1 has elapsed. Then, at Step SD20, the CPU 12 stops the waveform output of the sine waveform data of the sixteenth harmonic corresponding to "1'" and ends the key release processing.

As described above, in the key release processing, the stop timings of the fundamental and harmonic components respectively corresponding to each footage are changed to vary from one another in accordance with the wait time "TIME1" that changes based on key release speed, whereby the sine waveform data of the fundamental and harmonic components to be muted are changed to differ from one another. As a result, slight tone changes that occur at the start of muting in an actual drawbar organ are simulated in that, when the key release speed is fast, the variations in the stop timings of the fundamental and harmonic components decrease and the tone changes decrease, and when the key release speed is slow, the variations in the stop timings of the fundamental and harmonic components increase and the tone changes increase. In addition, a click sound whose waveform type and sound volume correspond to the key release velocity VEL1 is generated and mixed with the drawbar sound in which the slight tone changes occur at the start of muting. Therefore, performance expression more similar to that of an actual drawbar organ is realized.

As described above, in the present embodiment, key depression speed corresponding to a key depression operation is detected, and a click sound whose waveform type and sound volume correspond to the detected key depression speed is generated. In addition, the production timings of the fundamental and harmonic components respectively corresponding to each footage are changed to vary from one another in accordance with wait time "TIME" that changes based on the key depression speed, whereby the sine waveform data of the fundamental and harmonic components to be synthesized by additive synthesis are changed to differ from one another. Also, key release speed based on a key release operation is detected, and a click sound whose waveform type and sound volume correspond to the detected key release speed is generated. In addition, the stop timings of the fundamental and the harmonic components respectively corresponding to each footage are changed to vary from one another in accordance with wait time "TIME1" that changes based on the key release speed, whereby the sine waveform data of the fundamental and the harmonic components to be muted are changed to differ from one another. Accordingly, by the click sound being mixed with the drawbar sound in which the slight tone changes occur at the start of sound production (or at the start of muting), a drawbar sound having performance expression equivalent to that of an actual drawbar organ are generated. That is, a unique drawbar sound such as that generated by the sound producing mechanism of an actual drawbar organ is generated.

In the above-described embodiment, the production timings (or stop timings) of fundamental and harmonic components respectively corresponding to each footage are sequentially changed to vary from one another in accordance with a certain amount of wait time "TIME" (or "TIME1") calculated as the inverse 1/VEL (or 1/VEL1) of key depression speed (or key release speed). However, the present invention is not limited thereto, and a configuration may be adopted in which, every time a wait time that randomly changes has elapsed, the production of a fundamental and a plurality of harmonics is randomly specified, whereby the production timings of the fundamental and the plurality of harmonics vary from one another. As a result, slight tone changes during key depression (or key release) which occur every time key depression and release operations are performed can be varied for each key depression or release operation.

In addition, in the present embodiment, a click sound whose waveform type and sound volume correspond to key depression speed (or key release speed) is generated. However, a configuration may be adopted in which the waveform type and sound volume of a click sound are randomly varied based on key depression speed (or key release speed). As a result, a sound more similar to the drawbar sound can be created.

While the present invention has been described with reference to the preferred embodiments, it is intended that the invention be not limited by any of the details of the description therein but includes all the embodiments which fall within the scope of the appended claims.

What is claimed is:

1. A musical sound producing apparatus comprising:

a sound source which produces a fundamental and a plurality of harmonics of a musical sound;

a sound production timing generating section which generates sound production timings of the fundamental and the plurality of harmonics to be produced by the sound source, based on a key depression operation;

a sound production instructing section which instructs the sound source to produce the fundamental and the plurality of harmonics based on the sound production timings generated by the sound production timing generating section;

a key release speed acquiring section which acquires a key release speed in response to a key release operation;

a muting timing changing section which changes muting timings of the fundamental and the plurality of harmonics produced by the sound source, based on the key release speed acquired by the key release speed acquiring section; and a muting instructing section which instructs the sound source to mute the fundamental and the plurality of harmonics based on the muting timings changed by the muting timing changing section.

2. The musical sound producing apparatus according to claim 1, further comprising:

a key depression speed acquiring section which acquires a key depression speed in response to the key depression operation, wherein the sound production timing generating section includes a sound production timing changing section which changes the sound production timings of the fundamental and the plurality of harmonics produced by the sound source, based on the key depression speed acquired by the key depression speed acquiring section.

3. The musical sound producing apparatus according to claim 2, wherein the sound production timing changing section (i) includes a first wait time generating section which generates a first wait time corresponding to the key depression speed, and (ii) changes the sound production timings of the fundamental and the plurality of harmonics, by the sound production instructing section instructing to produce the fundamental and the plurality of harmonics one by one every time the first wait time has elapsed.

4. The musical sound producing apparatus according to claim 3, wherein the first wait time generating section calculates the first wait time from an inverse of the key depression speed.

5. The musical sound producing apparatus according to claim 1, wherein the muting timing changing section (i) includes a second wait time generating section which generates a second wait time corresponding to the key release speed, and (ii) changes the muting timings of the fundamental and the plurality of harmonics, by the muting instructing section instructing to mute the fundamental and the plurality of harmonics being produced, one by one every time the second wait time has elapsed.

6. The musical sound producing apparatus according to claim 5, wherein the second wait time generating section calculates the second wait time from an inverse of the key release speed.

7. The musical sound producing apparatus according to claim 2, wherein an order in which the sound production timing changing section changes the sound production timings of the fundamental and the plurality of harmonics differs from an order in which the muting timing changing section changes the muting timings of the fundamental and the plurality of harmonics.

8. The musical sound producing apparatus according to claim 2, wherein the sound production timing changing section randomly specifies sound production of the fundamental and the plurality of harmonics, and thereby changes the sound production timings of the fundamental and the plurality of harmonics.

9. The musical sound producing apparatus according to claim 1, further comprising a key depression click sound producing section which produces a key depression click sound corresponding to the key depression operation.

10. The musical sound producing apparatus according to claim 9, further comprising:

a key depression speed acquiring section which acquires a key depression speed in response to the key depression operation, wherein at least one of a waveform type and a sound volume of the key depression click sound is changed randomly based on the key depression speed.

11. The musical sound producing apparatus according to claim 1, further comprising a key release click sound producing section which produces a key release click sound corresponding to the key release operation.

12. The musical sound producing apparatus according to claim 11, wherein at least one of a waveform type and a sound volume of the key release click sound is changed randomly based on the key release speed.

13. A non-transitory computer-readable storage medium having stored thereon a program that is executable by a computer used in a musical sound producing apparatus, the program being executable by the computer to perform functions comprising:

sound production timing generation processing for generating sound production timings of a fundamental and a plurality of harmonics of a musical sound to be produced by a sound source, based on a key depression operation;

sound production instruction processing for instructing the sound source to produce the fundamental and the plurality of harmonics based on the sound production timings generated by the sound production timing generation processing;

key release speed acquisition processing for acquiring a key release speed in response to a key release operation;

muting timing change processing for changing muting timings of the fundamental and the plurality of harmonics produced by the sound source, based on the key release speed acquired by the key release speed acquisition processing; and muting instruction processing for instructing the sound source to mute the fundamental and the plurality of harmonics based on the muting timings changed by the muting timing change processing.

14. A musical sound producing method used for a musical sound producing apparatus comprising:

a sound production timing generating step of generating sound production timings of a fundamental and a plurality of harmonics of a musical sound to be produced by a sound source, based on a key depression operation;

a sound production instructing step of instructing the sound source to produce the fundamental and the plurality of harmonics based on the sound production timings generated in the sound production timing generating step;

a key release speed acquiring step of acquiring a key release speed in response to a key release operation;

a muting timing changing step of changing muting timings of the fundamental and the plurality of harmonics produced by the sound source, based on the key release speed acquired by the key release speed acquiring step; and a muting instructing step of instructing the sound source to mute the fundamental and the plurality of harmonics based on the muting timings changed in the muting timing changing step.

* * * * *